US006334694B1

(12) United States Patent
Huang

(10) Patent No.: US 6,334,694 B1
(45) Date of Patent: Jan. 1, 2002

(54) COLLAPSIBLE CHRISTMAS TREE

(76) Inventor: Shun-Feng Huang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/721,783

(22) Filed: Nov. 20, 2000

Related U.S. Application Data

(62) Division of application No. 09/693,023, filed on Oct. 19, 2000.

(51) Int. Cl.[7] ..... F21P 1/02
(52) U.S. Cl. ..... 362/123; 362/252; 428/20
(58) Field of Search ..... 362/123, 249, 362/252, 806; 428/18, 19, 20; 211/196

(56) References Cited

U.S. PATENT DOCUMENTS 3,704,366 A * 11/1972 Korb et al. ..... 362/123
4,142,012 A * 2/1979 Clamage ..... 428/20
4,746,022 A * 5/1988 Benham ..... 211/196
5,359,502 A * 10/1994 Cantin ..... 362/123
5,405,662 A * 4/1995 Oberzan ..... 428/20
6,200,656 B1 * 3/2001 Tsang ..... 428/20

* cited by examiner

*Primary Examiner*—Sandra O'Shea
*Assistant Examiner*—Peggy A Neils

(57) ABSTRACT

A collapsible Christmas tree includes a collapsible circular support having a tubular seat at a center, a combinable post having a lower end inserted into the tubular seat and secured by a lock, a top ring inserted into the top of the post, a decoration inserted into the top of the top ring, a plurality of cords fastened spaced a part between the top ring and the circular support and a piece of netted Christmas lights covered on the outer peripheral portion of the cords. So that a Christmas tree of conic configuration is therefore accomplished.

3 Claims, 9 Drawing Sheets

COLLAPSIBLE CHRISTMAS TREE

This is a division of a U.S. pending application Ser. No. 09/693,023 Filed Oct. 19, 2000.

BACKGROUND OF THE INVENTION

The present invention relates to the Christmas tree and more particularly to a collapsible Christmas tree which is readily to prop up and to dismantle.

Conventional Christmas tree is made of the pine or fir felled from the woods which is uneconomical and unsuitable to the environmental requirement. According to the experts on forestry, these trees have same kind of the bacteria that may hurt people. Therefore, the artificial Christmas tree is provided. This artificial Christmas tree is combined by a lots of pine needles made of plastic material and decorated with the strings of the Christmas lights. It is known that to assemble or disassemble an artificial Christmas tree is a wearisome job.

U.S. Pat. No. 5,823,659 discloses a different kind of the artificial Christmas tree which adapts strings of Christmas lights to spiral them upward and then to connect them into a tree shape. However, it is difficult to flatten them out without a support.

SUMMARY OF THE PRESENT INVENTION

The present invention has a main object to provide a collapsible Christmas tree which is readily to assemble or to disassemble and easy to form a tree shape.

Another object of the present invention is to provide a collapsible Christmas tree which can be packed into a small container in transportation.

Accordingly, the collapsible Christmas tree of the present invention comprises generally a collapsible circular support on the bottom, a small top ring on the top connected by a combinable post, a plurality of fillets or cords fastened spaced apart between the small top ring and the circular support to form a conic shaped Christmas tree and a piece of netted Christmas lights covering on the outer peripheral portion of the cords. A decoration may be inserted to the top of the small top ring.

The present invention will become more fully understood by reference to the following detailed description thereof when read in conjunction with the attached drawings.

DETAILED DESCRIPTION OF THE PREFERRED EMBODIMENT

Figure 1:
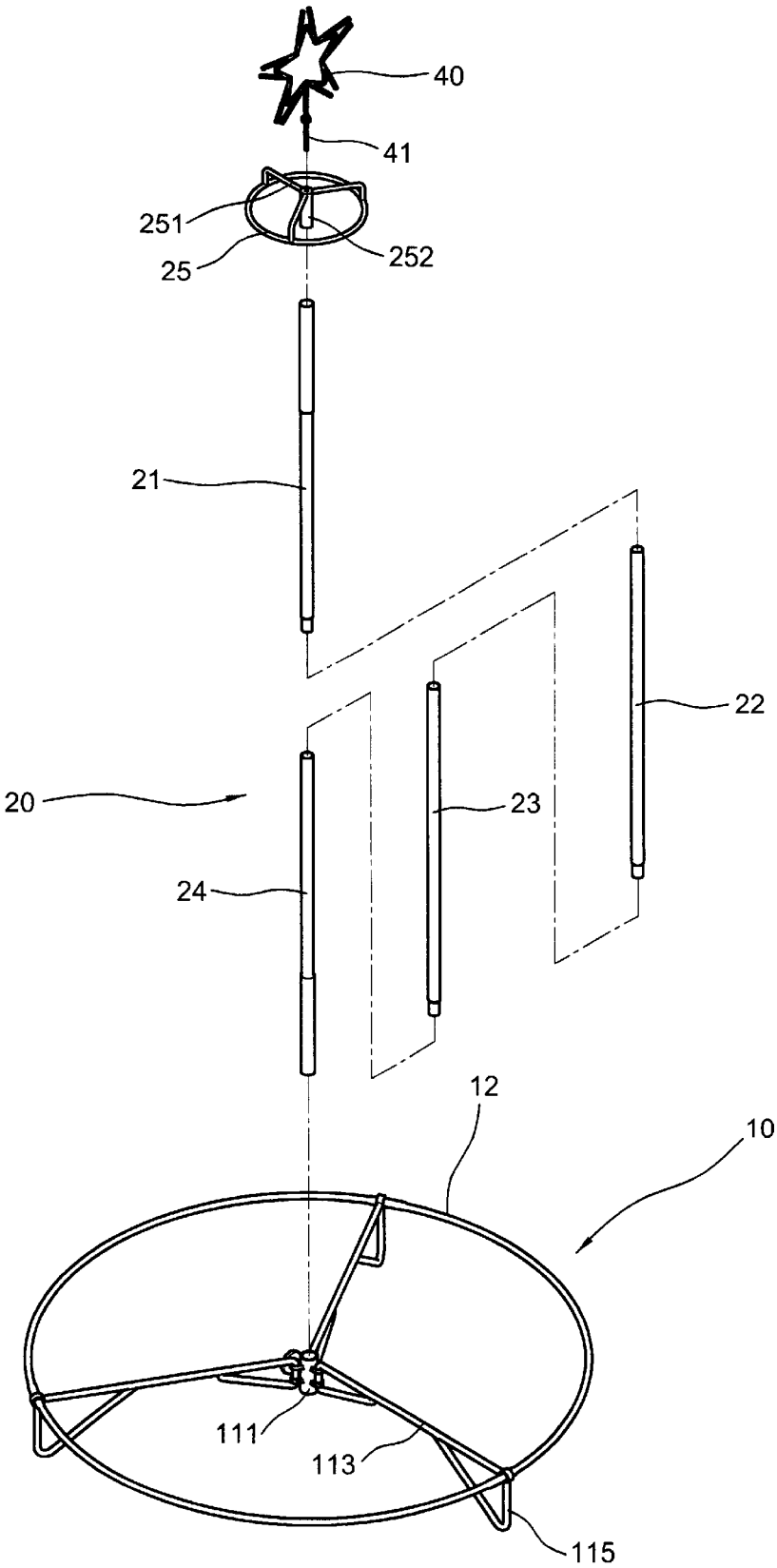
FIG. 1 is an exploded perspective view to show a collapsible Christmas tree according to the preferred embodiment of the present invention.
Figure 2:
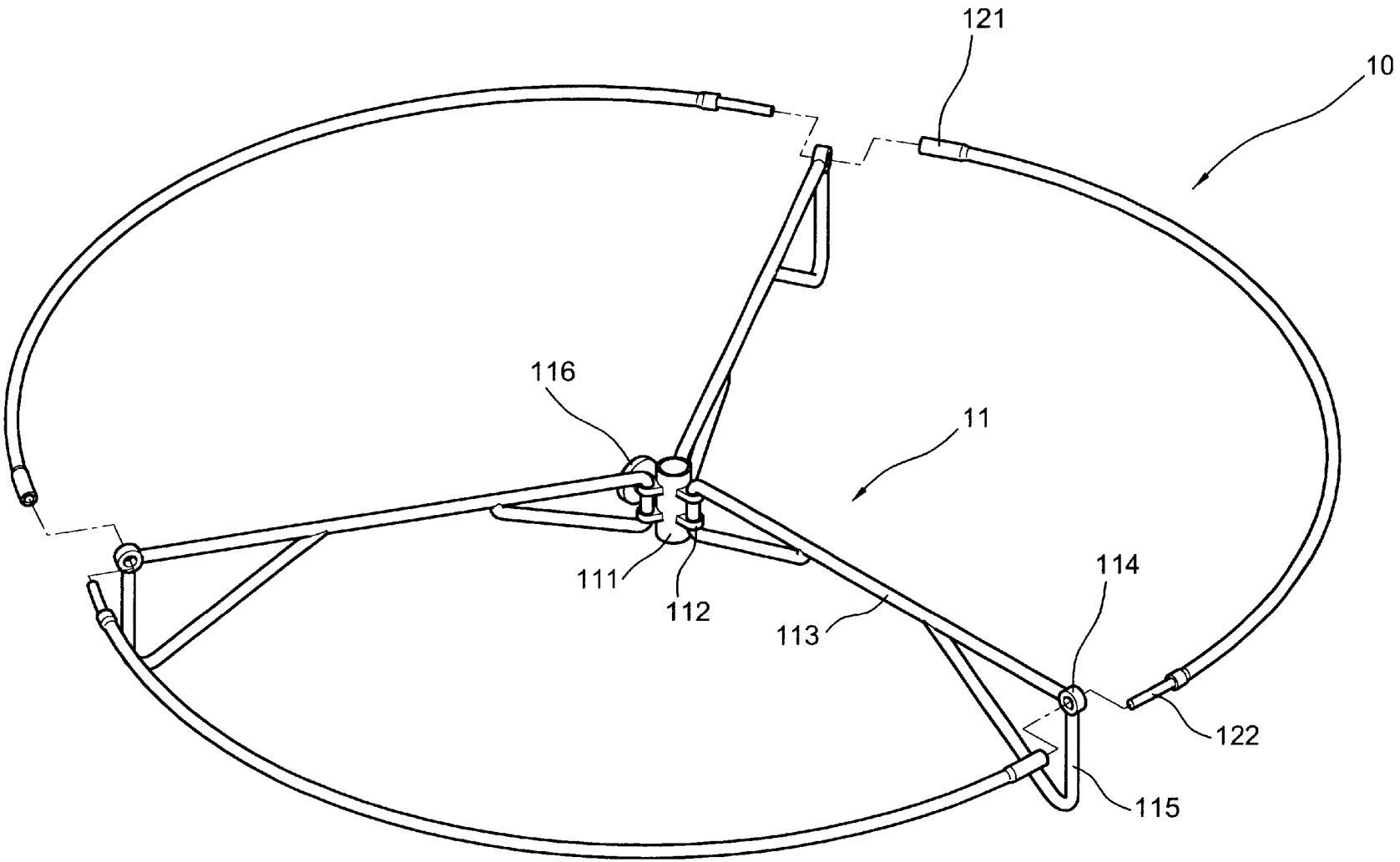
FIG. 2 is an exploded perspective view to show a circular support of the present invention.

With reference to FIGS. 1 and 2 of the drawings, the collapsible Christmas tree of the present invention comprises generally a circular support 10, a combinable post 20 engaged with the support 10 fastened by a lock 116, a small top ring 25 engaged with the top of the post 20 and a decoration 40 inserted to the top of the top ring 25.

Figure 6:
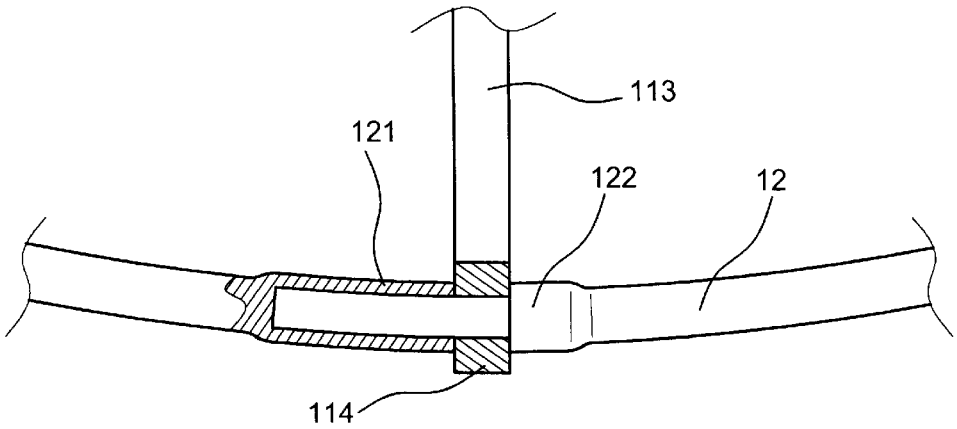
FIG. 6 is a sectional view to show the engagement between the arcuate frames.
Figure 7:
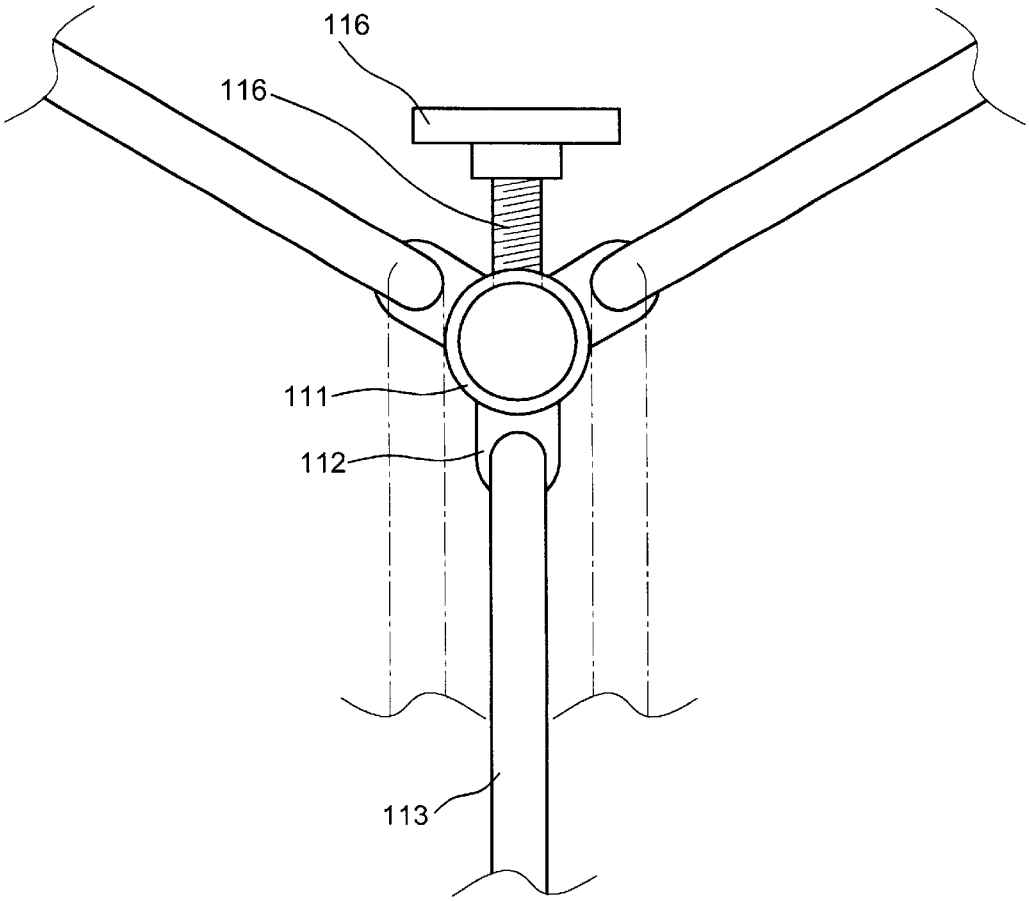
FIG. 7 is a top view to the collapsible Y-shaped frame of the circular support.

The circular support 10 has a tubular seat 111 at center, three buckles 112 formed spaced apart around the outer peripheral wall of the tubular seat 111, three radial extending rod 113 having their inner ends respectively hinged with the buckles 112, a retaining ring 114 at the outer end of each of the three radial extending rod 113 under which is a triangular foot 115 and three arcuate rods 12. The arcuate rods 12 each has a length equal to one third of the circumference of the circular support 10, an enlarged tubular end 121 and a reduced solid end 122. When assembling, respectively insert the reduced solid ends 122 through the corresponding retaining rings 114 then engage into the adjacent enlarged tubular ends 121 of next arcuate rods 12 (as shown in FIG. 6). Further, the three rods 11 form a roughly Y-shaped configuration when the circular support 10 is assembled (as shown in FIG. 2) and collapse together when the circular support 10 is disassembled (as shown in FIG. 7).

The combinable post 20 has an upper pipe 21, a pair of middle pipes 22 and 23 and a lower pipe 24. The upper pipe 21 has an enlarged top end and a reduced lower end. The middle pipes 22 and 23 each has a reduced lower end. The lower pipe 24 has an enlarged lower end engaged into the tubular seat 111 of the circular support 10. In combination, the reduced lower end of the middle pipe 23 inserts into the top of the lower pipe 24 and the reduced lower end of the middle pipe 22 inserts into the top of the middle pipe 23 and then the reduced lower end of the upper pipe 21 inserts into the top of the middle pipe 22.

The small top ring 25 has a distal tube 252 at center inserted into the top of the upper pipe 21 of the post 20 and reinforced by a plurality of radial ribs 251.

Figure 5:
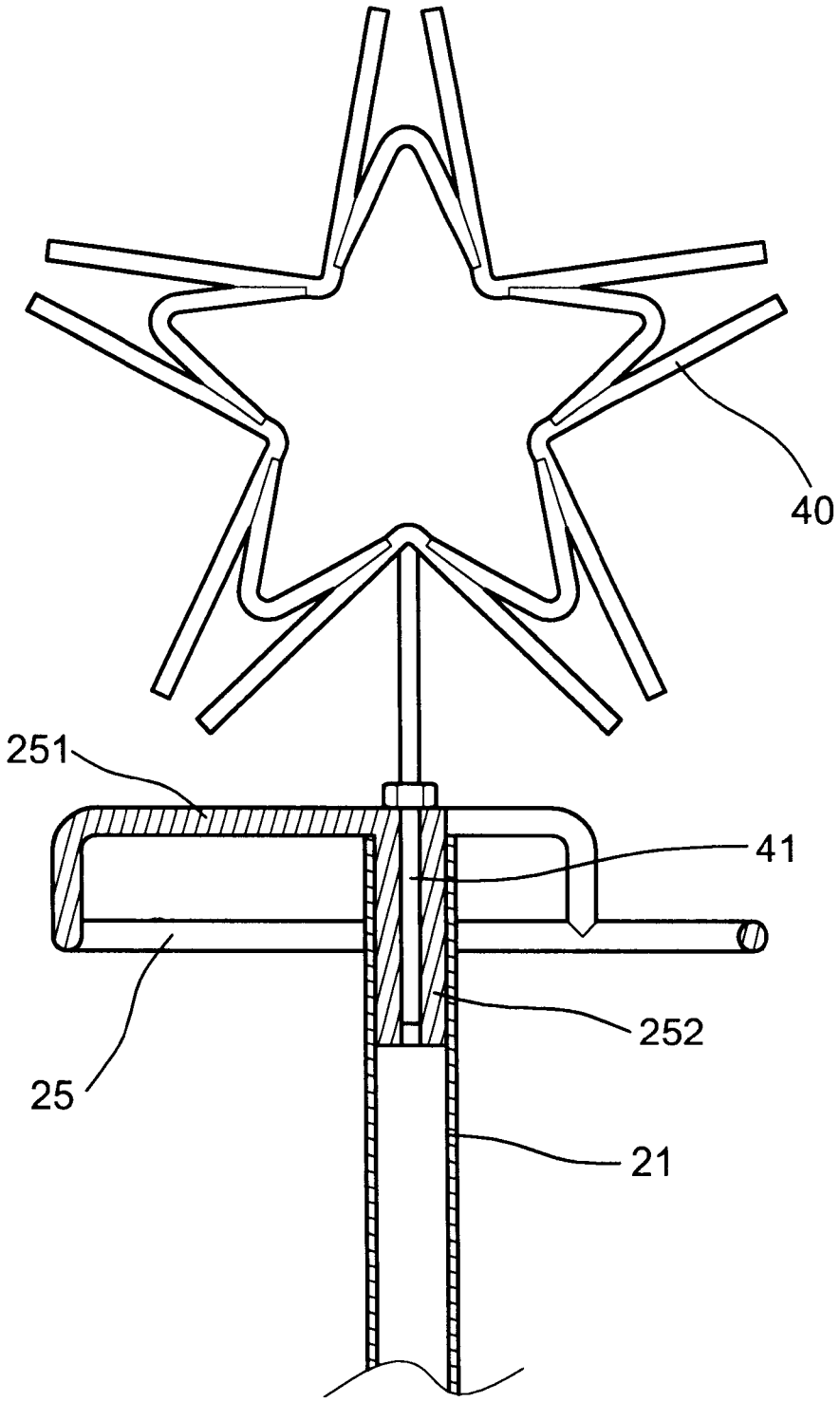
FIG. 5 is a sectional view to show the engagement of the decoration with the top ring.

The decoration 40 which is a star shape has an insertion pipe 41 inserted into the top of the distal tube 252 (as shown in FIG. 5).

Figure 3:
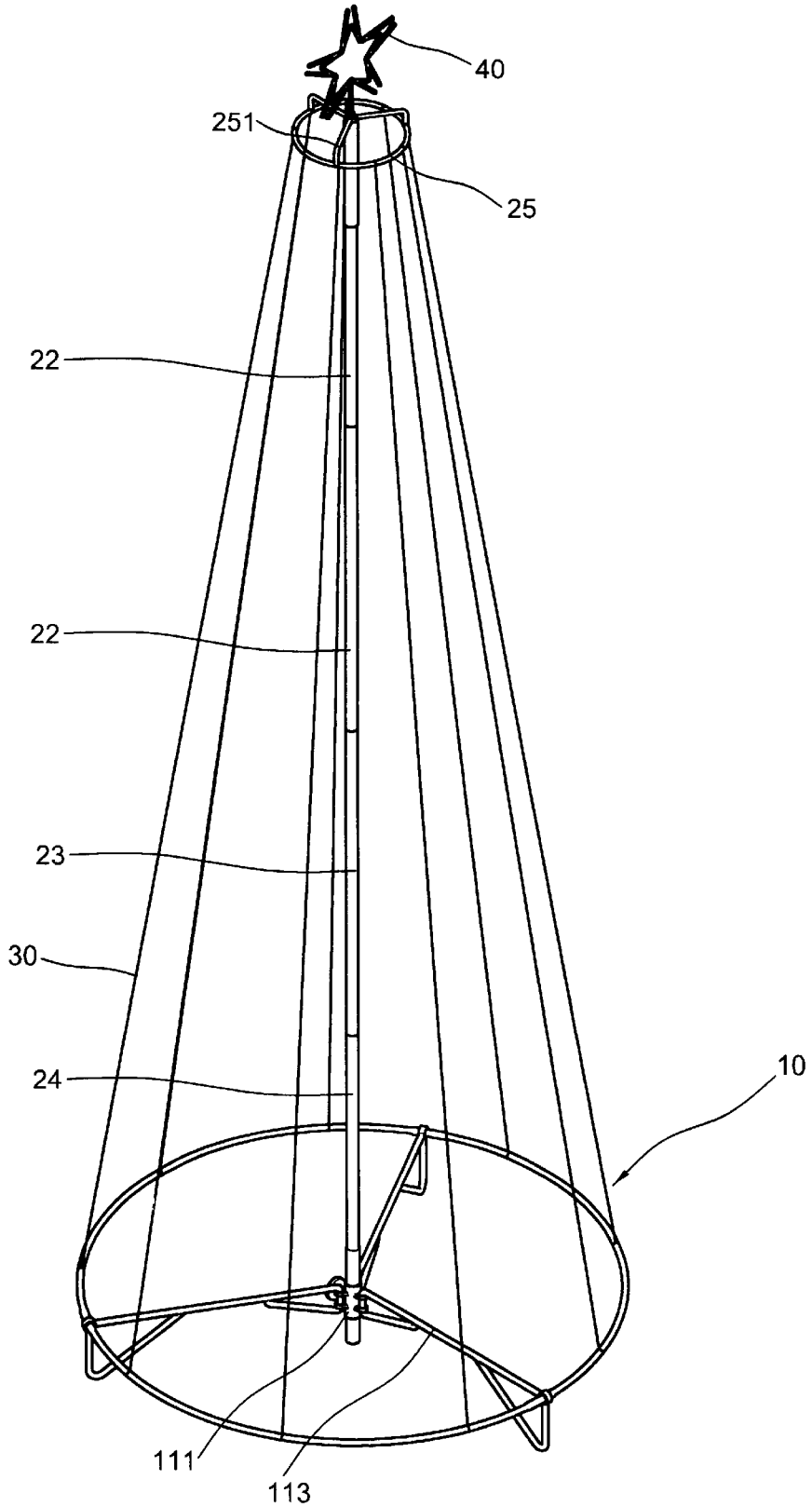
FIG. 3 is a perspective view to show the assembly of FIG. 1.

A plurality of cords 30 respectively fasten spaced apart to the small top ring 25 and the circular support 10 around the post 20 (as shown in FIG. 3).

Figure 4:
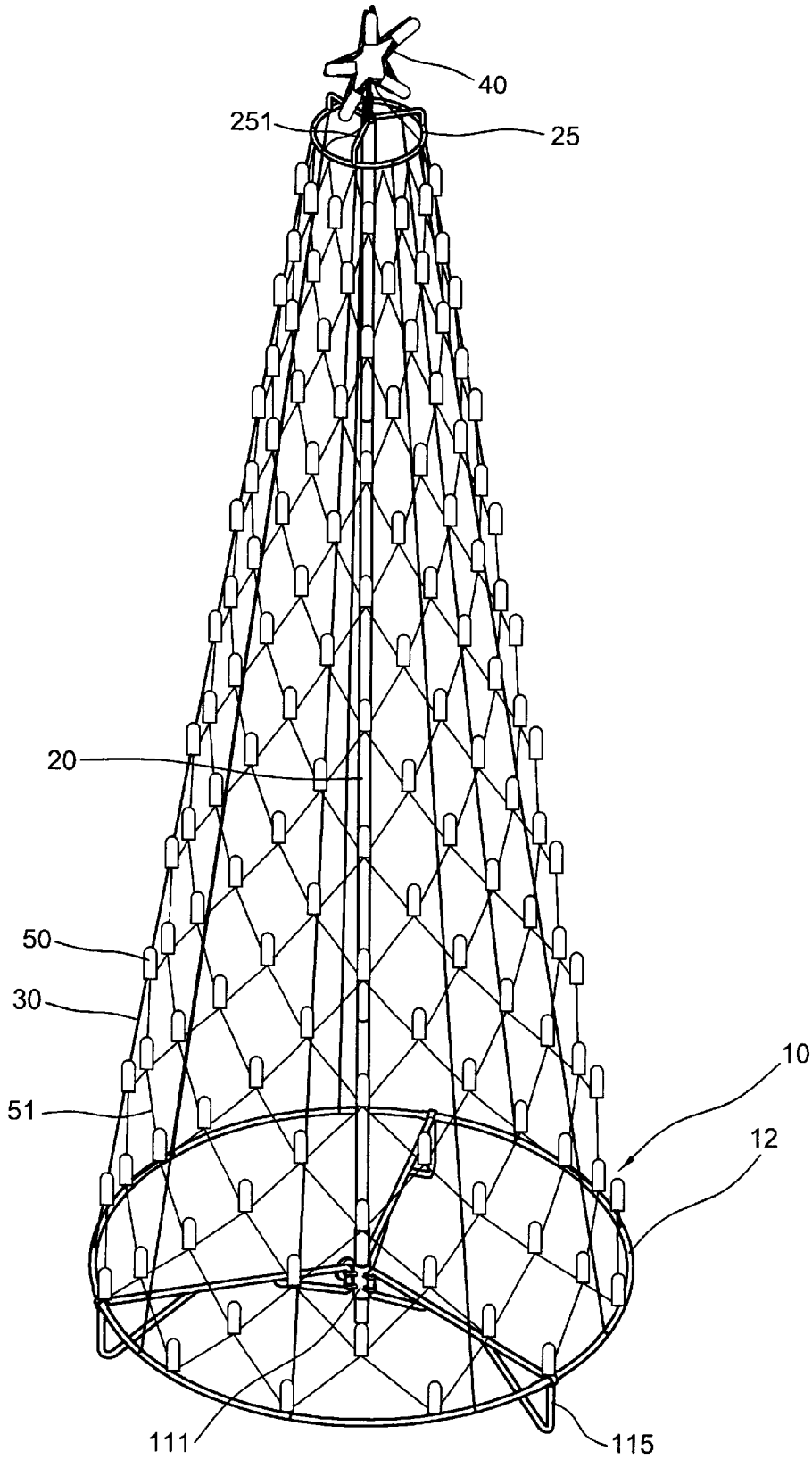
FIG. 4 is a perspective view to show a collapsible Christmas tree according to the present invention.
Figure 8:
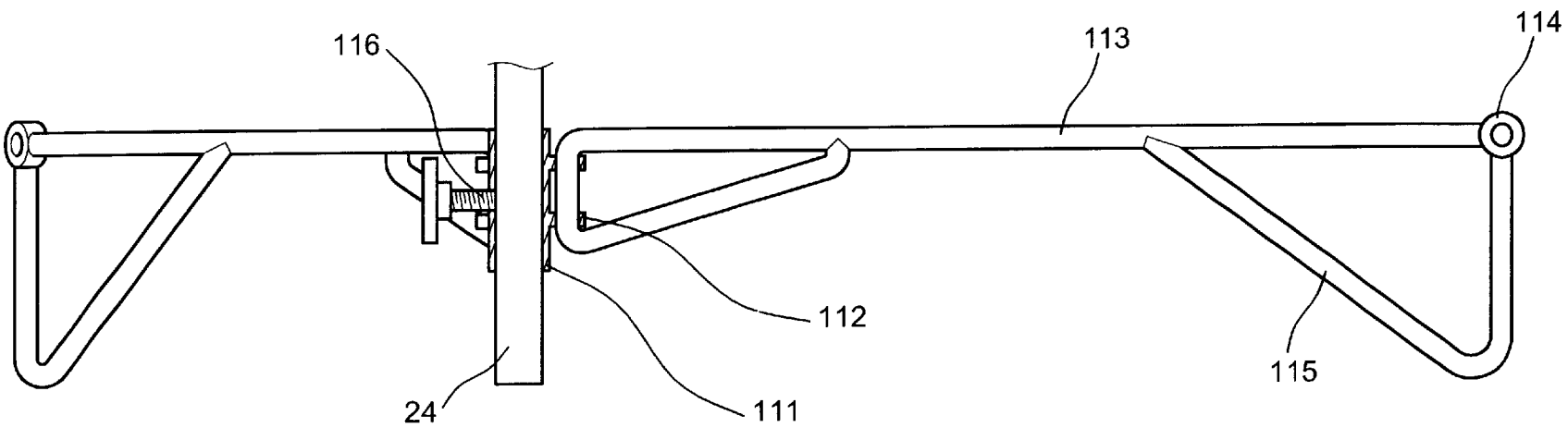
FIG. 8 is an elevational view to show the assembly of the circular support.
Figure 9:
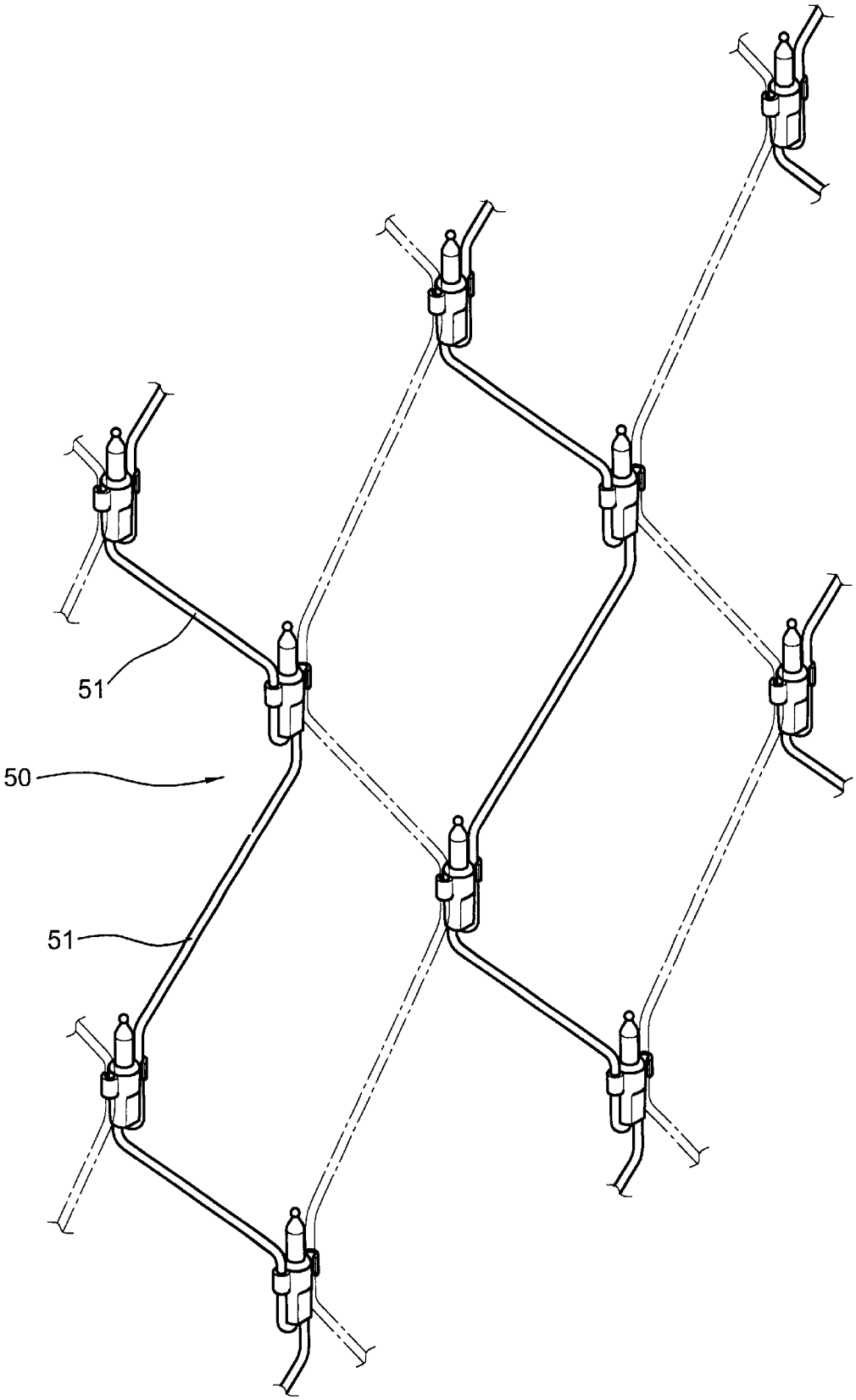
FIG. 9 is a perspective view to show a piece of the netted Christmas lights.

Finally, a piece of netted Christmas lights 50 connected by wires 51 (as shown in FIG. 9) covers on the cords 30 to accomplished a Christmas tree of conic shape (as shown in FIG. 4). FIG. 8 shows the assembly of the circular support 10.

Figure 10:
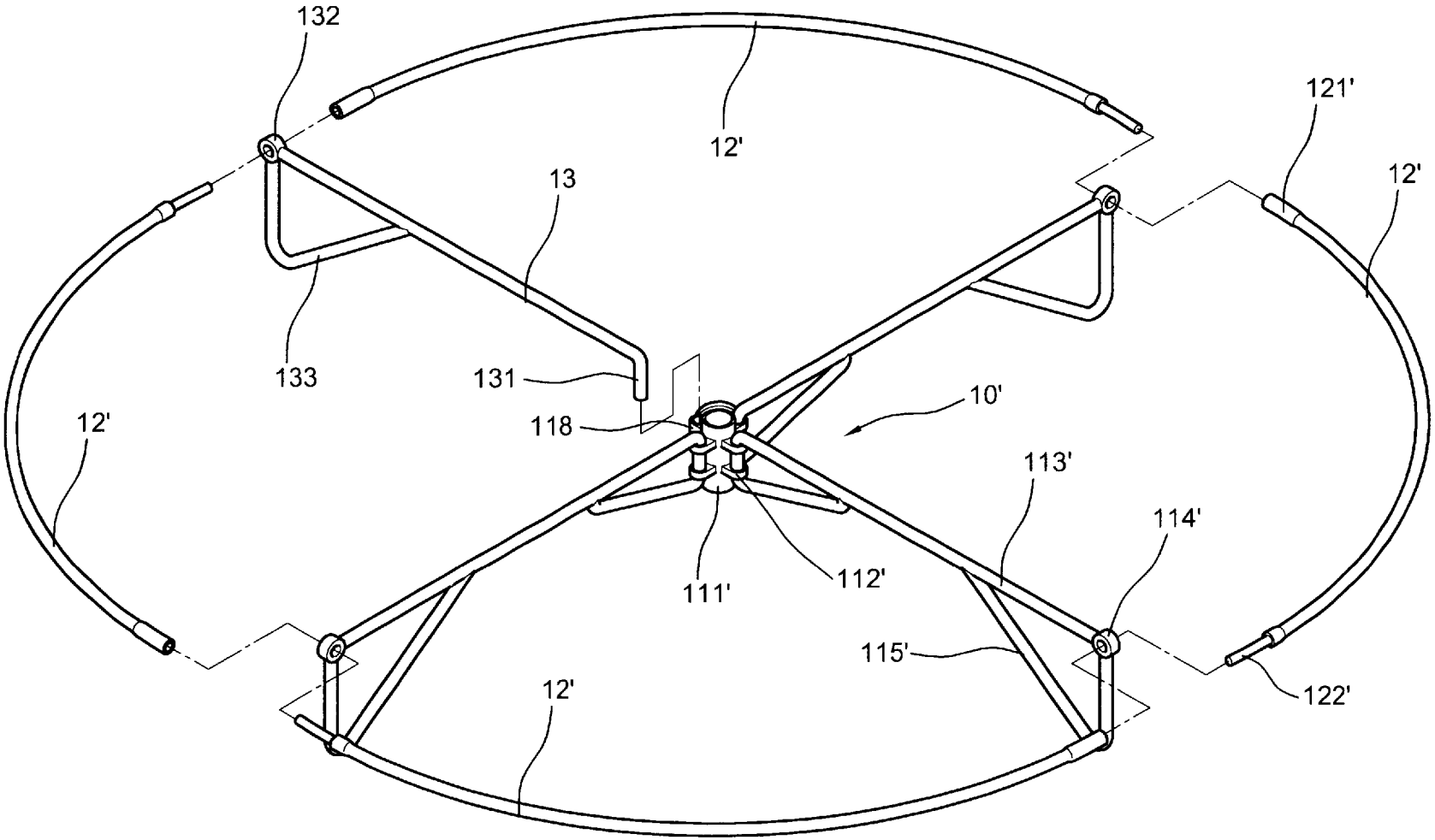
FIG. 10 is an exploded perspective view to show an alternate circular support of the present invention.

FIG. 10 shows an alternate circular support 10' which has a tubular seat 111' at center, three buckles 112' perpendicularly formed on outer periphery for hinging the inner ends of three first radial extending rod 113' each of which has a retaining ring 114' at outer end and a triangular foot 115' under the retaining ring 114', a single small tube 118 on an opposing periphery of the tubular seat 111' perpendicular to the buckles for releasably inserting a single radius extending rod 13 which has a bent downward inner end 131 engageable with the small tube 118, a retaining ring 132 at outer end and a triangular foot 133 under the retaining ring 132 so that the four radial extending rods 13 and 113' can make a cross configuration on the tubular seat 111'. Four arcuate rods 12' each has a length equal to one fourth of the circumference of the circular support 10', an enlarged tube 121' at one end and a reduced portion 122' at the other end. When assembling, first insert the bent down inner end 131 of the single radial extending rod 13 into the small tube 118 and make the four radial extending rods 13 and 113' into a cross, then insert the reduced portion 122' of each of the four arcuate rods 12' through the corresponding retaining ring 114' and engage it into the enlarged tube 121' of a next arcuate rod 12' so that a circular support 10' is therefor accomplished. When disassembling, reverse the above discussed process, then fold the support 10' into a small package that also saves a great space in transportation.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A collapsible Christmas tree comprising:

a circular support having a center, a circumference, a tubular seat vertically disposed at the center including three buckles projected spaced apart on an outer periphery for respectively hinging three radial extending rods each of which has a retaining ring at an outer end and a triangular foot under the retaining ring and three arcuate rods disposed around the circumference thereof each having a length equal to one third circumference, an enlarged tube at one end and a reduced portion at an opposite end inserted through said corresponding retaining ring and secured into the enlarged tube of an adjacent arcuate rod;

a combinable post combined with an upper pipe, a lower pipe and a pair of middle pipes, said lower pipe having an enlarged lower end releasably inserted into the tubular seat of the circular support and secured by a lock, said middle pipes each having a reduced portion releasably inserted with each other and then inserted into top of the lower pipe, said upper pipe having an enlarged portion on top and a reduced portion at lower end releasably inserted into top of a middle pipe;

a small top ring having a distal tube at a center reinforced by a plurality of radial ribs and releasably inserted into the enlarged portion of the upper pipe;

a decoration having a pin projected downward releasably inserted into top of the distal tube of the top ring;

a plurality of cords respectively fastened spaced apart between the top ring and the circular support around the combinable post;

a piece of netted Christmas light covering on outer peripheral portion of the cords;

whereby a Christmas tree of conic configuration is accomplished.

2. The collapsible Christmas tree as recited in claim 1 wherein said decoration is a star shaped.

3. A collapsible Christmas tree comprising:

a circular support having a center, a circumference, a tubular seat at the center including three buckles and a small tube projecting outward on an outer periphery positioned perpendicular to each other, three radial extending rods each having an inner end hinged on the buckles and an outer end connected to a retaining ring and a triangular foot under the retaining ring, a single radial extending rod having a bent downward inner end releasably inserted into the small tube and outer end connected to a retaining ring and a triangular foot under the retaining ring; four arcuate rods each having a length equal to one fourth of the circumference of the circular support, an enlarged tube at one end and a reduced portion at an opposite end inserted through said corresponding retaining ring and engaged within the enlarged tube of an adjacent arcuate rod;

a combinable post combined with an upper pipe, a lower pipe and a pair of middle pipes, said lower pipe having an enlarged lower end releasably inserted into the tubular seat of the circular support and secured by a lock, said middle pipes each having a reduced portion releasably inserted with each other and then inserted into an upper end of the lower pipe, said upper pipe having an enlarged portion on top and a reduced portion at a lower end releasably inserted into the top of a middle pipe;

a small top ring having a distal tube at a center reinforced by a plurality of radial ribs and releasably inserted into the enlarged portion of the upper pipe;

a decoration having a pin projected downward releasably inserted into the top of the distal tube of the top ring;

a plurality of cords respectively fastened spaced apart between the top ring and the circular support around the combinable post;

a piece of netted Christmas lights covering an outer peripheral portion of the cords;

whereby a Christmas tree of conic configuration is formed.

* * * * *